US007600383B2

(12) United States Patent
Bunel et al.

(10) Patent No.: US 7,600,383 B2
(45) Date of Patent: Oct. 13, 2009

(54) TURBOJET WITH PROTECTION MEANS FOR A FUEL INJECTION DEVICE, AN INJECTION DEVICE AND A PROTECTIVE PLATE FOR THE TURBOJET

(75) Inventors: Jacques Marcel Arthur Bunel, Fresnes (FR); Jacques André Michel Roche, Lisses (FR); Alain Pierre Page, Montgeron (FR)

(73) Assignee: SNECMA, Paris (FR)

( * ) Notice: Subject to any disclaimer, the term of this patent is extended or adjusted under 35 U.S.C. 154(b) by 614 days.

(21) Appl. No.: 11/175,191

(22) Filed: Jul. 7, 2005

(65) Prior Publication Data

US 2006/0016192 A1 Jan. 26, 2006

(30) Foreign Application Priority Data

Jul. 21, 2004 (FR) ..... 04 08059

(51) Int. Cl.
*F02K 3/10* (2006.01)

(52) U.S. Cl. ..... 60/765; 60/761; 60/766

(58) Field of Classification Search ..... 60/761–765, 60/766, 740

See application file for complete search history.

(56) References Cited

U.S. PATENT DOCUMENTS 5,179,832 A 1/1993 Barcza et al.
5,396,761 A * 3/1995 Woltmann et al. ..... 60/39.827
5,396,763 A * 3/1995 Mayer et al. ..... 60/765
6,112,516 A * 9/2000 Beule et al. ..... 60/765
6,463,739 B1 * 10/2002 Mueller et al. ..... 60/765
7,467,518 B1 * 12/2008 Vermeersch ..... 60/776
2002/0189259 A1 12/2002 Laing et al.

FOREIGN PATENT DOCUMENTS

EP 0 744 543 A1 11/1996
EP 1 132 687 A1 9/2001
FR 1 364 192 6/1964
FR 2 689 211 10/1993
FR 2 770 284 4/1999

* cited by examiner

*Primary Examiner*—Michael Cuff
*Assistant Examiner*—Gerald L Sung
(74) *Attorney, Agent, or Firm*—Oblon, Spivak, McClelland, Maier & Neustadt, L.L.P.

(57) ABSTRACT

The turbojet of the invention includes a combustion chamber, a channel for heating the gas stream, where the heating channel includes at least one device for injection of fuel into the gas stream, which includes an open chamber, with a U-shaped section, having at least one wall within which extend fuel-injection means, which inject the fuel in at least one direction. It is characterised by the fact that a cooling jacket is provided in the chamber, alongside the wall forming the base of its U-section, and the fuel injection device includes protection means interposed between the fuel-injection means and the wall, in a fuel-injection direction.

Thus, as a result of the invention, the fuel injection device, which is bathed in a very hot environment, is protected against thermal shocks due to the projection of colder fuel onto its walls, and its life expectancy is therefore increased.

21 Claims, 3 Drawing Sheets

TURBOJET WITH PROTECTION MEANS FOR A FUEL INJECTION DEVICE, AN INJECTION DEVICE AND A PROTECTIVE PLATE FOR THE TURBOJET

The invention concerns a turbojet which has a channel for heating of the primary gas flow, with a fuel injection device and protection means for the fuel injection device. The invention also concerns a fuel injection device and a protective plate for the said turbojet.

Turbojets which are described as "post combustion" generally include, from upstream to downstream in the direction of flow of the gases, one or more compressor stages, a combustion chamber, one or more turbine stages, a heating or post combustion channel, and an exhaust nozzle. The primary gas flow, downstream of the turbine stages, allows a fresh combustion, as a result of the oxygen still present within it, in the heating channel before expanding in the exhaust nozzle.

At the entrance of the heating channel, flame holder arms extend radially into the gas stream. They are of U-shaped section, the branches of the U being orientated in the downstream direction, and have within them a fuel injector projecting the latter into the stream of gas in the downstream direction. The fuel is ignited and the flames are attached to the walls of the arms because the shape of the arm section creates a zone with a lower pressure. A flame holder ring, concentric with the housing of the heating channel, can also be provided in the gas jet of the primary stream. This functions on the same principle.

The primary stream is at a temperature of about 950° C. The walls of the flame holder arms, although cooled by a jacket fed with air from the secondary air stream at 200 or 250° C., are at a temperature of around 800 to 850° C., in particular at their trailing edge, while the flames attached to the arms are at a temperature of 1700° C. The fuel is projected at a temperature of about 100° C., or more precisely between 50 and 150° C., against the walls of the arm at 850° C.

The thermal gradients resulting from this impact are very large, and lead to deformation of the arms, in particular at their trailing edge. Because of this, their life expectancy is reduced, this being all the more serious since the arms are generally made from castings in Cobalt-based alloys, and are difficult to replace. The maintenance costs are therefore very high.

In the case of an annular injection device with two walls forming a chamber that is open upstream and downstream, document U.S. Pat. No. 5,179,832 proposes, a protective plate adjacent to the external wall, against which the fuel is projected. The fuel is projected by a fuel injector tube standing away from the inner end of the upstream jet of the chamber. Such protection is not satisfactory however, in the case of a chamber that is closed on the upstream side.

This present invention aims to overcome these drawbacks.

To this end, the invention concerns a turbojet that includes a channel for heating of the gas stream, where the heating channel includes at least one device for the injection of fuel into the gas stream, which includes an open chamber with a U-shaped section and with at least one wall, and within which extend of fuel-injection means which inject the fuel in at least one direction, characterised by the fact that a cooling jacket is provided in the chamber, alongside the wall forming the base of its U-section, and the fuel injection device includes protection means interposed between the fuel-injection means and the wall, in a fuel-injection direction.

Preferably, the protection means include at least one plate.

Again preferably, the injection device comes in the form of a radial arm.

Advantageously in this case, the protection means extend along the full radial height of the arm.

Preferably again, the fuel-injection means include at least one tube, supplied with fuel and including fuel-injection orifices.

Advantageously, the fuel injection device also includes a protective screen, placed in the opening of the chamber, the protection means being positioned between a wall of the chamber and the protective screen.

Depending on the form of implementation, the fuel-injection means are placed between the walls forming the branches of the U-section of the chamber.

Preferably in this case, a plate is placed more or less parallel to each of the walls of the chamber forming the branches of its U-section.

Depending on the form of implementation, each plate is attached to the wall to which it is more or less parallel.

According to another form of implementation, each plate is attached to the cooling jacket.

According to yet another form of implementation, the plate includes a U-section, and a radial recess in the central part of the wall forming the base of its U-section, which is slid onto a part forming a slide, attached to the cooling jacket.

The invention also concerns a fuel injection device for the above turbojet.

The invention again concerns a protective plate for a fuel injection device for the above turbojet.

The invention will be better understood with the aid of the following description of the preferred form of implementation of the turbojet of the invention, with reference to the appended drawings, in which.

Figure 1:
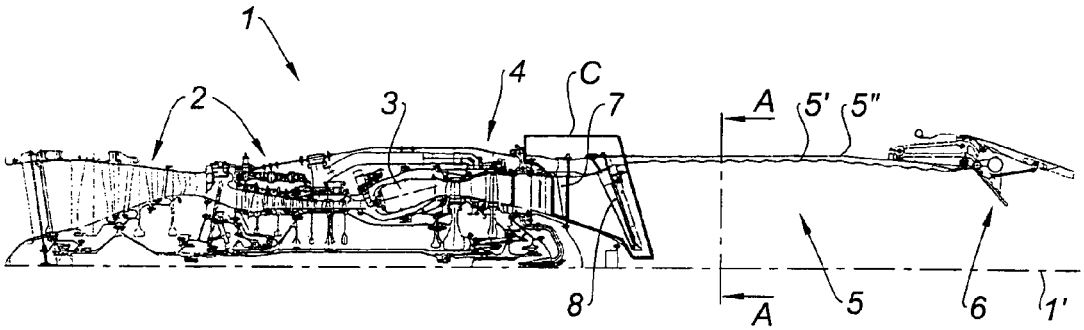
FIG. 1 represents a partial view in axial section of the preferred form of implementation of the turbojet of the invention.

With reference to FIG. 1, the turbojet 1 of the invention, which extends along an axis 1', includes several compressor stages 2, a combustion chamber 3, several turbine stages 4, a channel for heating of the primary stream 5 and an exhaust nozzle 6. The heating channel 5 is delimited by an internal jacket 5' surrounded by a external housing 5". These two elements 5', 5" delimit between them a passage for cooling air.

At the entrance of the heating channel 5, fuel-injector arms 7, attached to the external housing 5" and to the internal jacket 5' of the heating channel 5, extend radially. The function of the injectors is to vaporise fuel in the direction of flame holder arms 8, located downstream in the heating channel 5.

Figure 2:
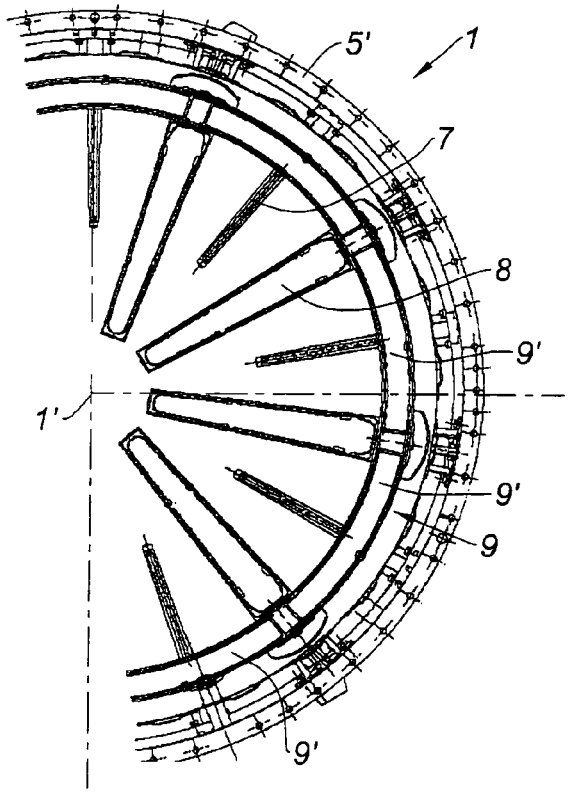
FIG. 2 represents a view in transverse section of the turbojet of FIG. 1, in direction A-A.

With reference to FIG. 2, the flame holder arms 8 are the same in number, here nine, as the fuel-injector arms 7 and are angularly offset in relation to the latter, so that when viewed face on, each fuel injector arm 7 is located between two adjacent flame holder arms 8, and equidistant from each. The fuel-injector arms 7 are radially smaller than the flame holder arms 8.

Close to the internal jacket 5' of the heating channel 5, in the heating channel of the primary stream 5, the flame holder arms 8 support a flame holder ring 9. This ring 9 is composed of a multiplicity of portions of ring 9', nine in number, which extend, concentrically to the housings 5', 5" of the heating channel 5, between two successive flame holder arms 8.

Figure 3:
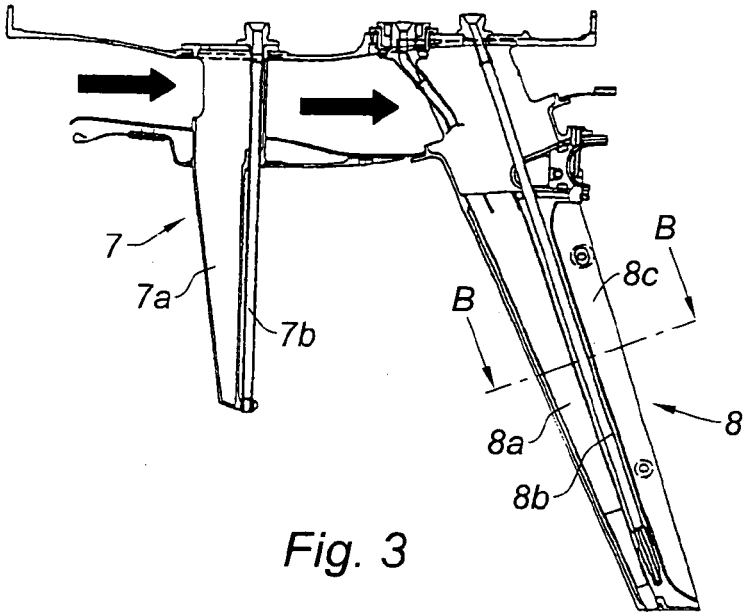
FIG. 3 represents an enlarged view of the area of FIG. 1 contained in frame C.

With reference to FIG. 3, a fuel injector arm 7 includes a radial cooling jacket 7*a*, extending over all of the radial height of the arm 7, parallel to which extends, downstream, a fuel injector tube 7*b*, supplied with fuel from the exterior of the external housing 5" of the heating channel 5 and including fuel vaporisation jets. The cooling jacket 7*a* is fed with cooling air, taken from the secondary air stream. It includes jets which are used to cool the arm 7 by air impact. The fuel-injector arms 7 extend radially at right angles to the axis 1' of the turbojet 1.

The flame holder arms 8 extend radially, inclined in the downstream direction, from their base attached to the external housing 5" of the heating channel 5, in relation to the perpendicular to the axis 1' of the turbojet 1 contained in the axial plane of the arm 8. A flame holder arm 8 includes an open chamber, delimited by walls 8'—which can be replaced in a similar manner by a continuous wall 8'—in which its various elements are contained. The flame holder arm includes a radial cooling jacket 8*a*, extending over all of the radial height of the arm 8, parallel to which extends, downstream, a fuel injector tube 8*b*, supplied with fuel from the exterior of the external housing 5" and including jets for projection of the fuel.

The simplified operation of the turbojet is as follows. Fuel is vaporised by the fuel injector tubes 7*b* of the fuel-injector arms 7 and by the fuel injector tubes 8*b* of the flame holder arms 8. As a result of the residual oxygen in the primary gas flow, and also due to a contribution of air from the secondary stream, this fuel undergoes combustion. This combustion occurs at the flame holder arms 8, the shape of which causes the attraction of the flames by the said arms 8. This combustion, known as post combustion or re-heating, provides additional impulsion to the turbojet. This process of post combustion is well known to the professional engineer and will therefore not be treated in greater detail here. The gas then expands in the heating channel 5 and in the exhaust nozzle 6 before of being ejected out of the turbojet 1.

Figure 4:
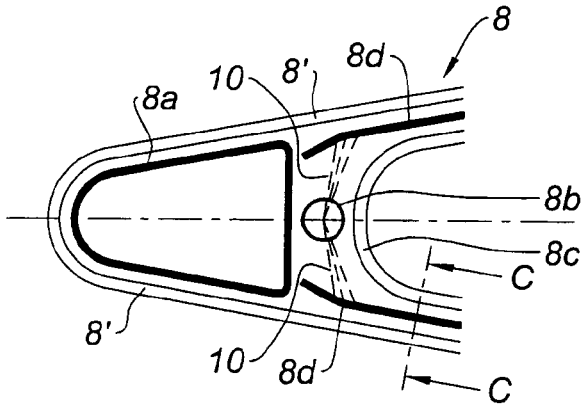
FIG. 4 represents a view in section of the flame holder arm of FIG. 3, in direction B-B.

With reference to FIG. 4, the external walls 8' of a flame holder arm 8, delimiting its open chamber, present a U-section, the branches of which are turned in the downstream direction. More precisely, the branches of the U are not parallel; they are more like a V with a rounded base; in the remainder of the document however, we will speak of a U-section. The cooling jacket 8*a* occupies the upstream portion of this U-section, that is its closed portion. This jacket 8*a* includes a multiplicity of jets, typically nine hundred in number, by which the air of the secondary stream with which it is fed is projected, in order to cool the walls 8' of the arm 8. Just downstream, centred in relation to the walls 8', extends the fuel injector tube 8*b*. Downstream of this tube 8*b* extends a protective screen 8*c*, also of U-section, the function of which is to protect the fuel injector tube 8*b* and the cooling jacket 8*a* of the flame attracted to the trailing edges of the walls 8' of the arm 8. This screen 8*c* occupies virtually all the space left between the extremity of the walls 8' of the arm 8 forming the branches of its U-section.

A protective plate 8*d* extends between the walls of the protective screen 8*c* and the walls 8' of the arm 8. Its function is to prevent a direct impact of the fuel onto the walls 8' of the arm 8, the drawbacks of which have been presented above. In the form of implementation of FIG. 4, the flame holder arm 8 includes two protective plates 8*d*, extending more or less parallel to the two walls 8' forming the branches of the U-section of the arm 8, from the cooling jacket 8*a*, though not in contact with it and forming, in its proximity, a slight elbow inside the arm, up to the trailing edges of the arm 8. The plates 8*d* extend over all of the radial height of the arm 8.

Thus the fuel, indicated by dashed lines 10, is sprayed from the fuel injector tube 8*d* onto the protective plates 8*d*, before being ejected, between the said plates 8*d* and the protective screen 8*c*, beyond the arm 8, where it is ignited.

Figure 5:
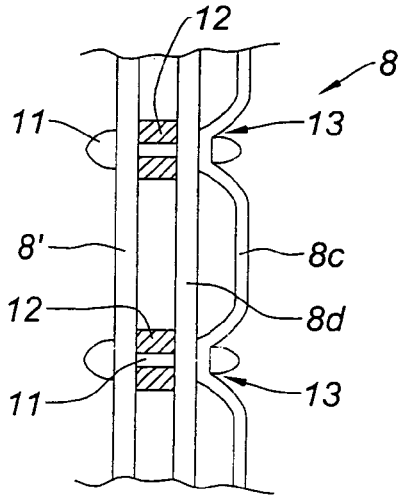
FIG. 5 represents a view in section of the flame holder arm of FIG. 4, in direction C-C.

In FIG. 5 we see the method for attaching a protective plate 8*d* within an arm 8. The protective plate 8*d* is attached to the wall 8' of the arm 8, to which it is more or less parallel, by securing pins 11 passing through holes that have been provided for this purpose in the plate 8*d* and the wall 8'. In order to keep an adequate distance between the wall 8' of the arm 8 and the protective plate 8*d*, this distance being necessary for a certain thermal independence between these two elements and therefore for acceptable protection of the wall 8' of the arm 8, spacers 12 are positioned between their facing surfaces, around the securing pins 11.

The protective screen 8*c* is fixed to the protective plate 8*d* at the portions of its walls that correspond to the branches of its U-section, by the same securing pins 11. Such a portion of wall generally takes the form of a plate, including indentations 13 in which holes are drilled for passage of the securing pins 12. Thus, the screen 8*c* is pinned onto the plate 8*d* at the location of the indentations 13, while the major part of its surface is held away from the plate 8*d*, so as to leave a space for passage of the fuel 10.

The securing pins 11 are not specified, and will be chosen by the engineer concerned.

As a result of the protective plates 8*d*, the fuel 10 projected by the tube 8*b* does not make contact with the walls 8' of the arm 8, the temperature of which is very high, and so prevents them from being subjected to excessive temperature gradients. It is projected onto the protective plates 8*d*, which are located inside the space defined by the walls 8' of the arm 8, and are at a lower temperature, due in particular to the cooling provided by the jacket 8*a*. Their temperature is typically 600 to 650° C., instead of 850° C. for the walls 8' of the arm 8. The thermal gradient to which they are subjected is therefore less severe. The plates 8*d* can be composed of any ad-hoc material, such as metal, ceramics or ceramic matrix components (CMC).

The plates 8*d* thus protect the walls 8' of the arm 8, since they are placed between the tube 8*b* and the walls 8' of the arm, in the fuel-injection direction. They undergo deformations, but once deformed, they are easily to replace, or at least easier than the walls 8' of the arm 8, resulting in lower maintenance costs than for structures of earlier design.

Other methods of attachment and other shapes of the protective plates 8*d* can also be envisaged.

Figure 6:
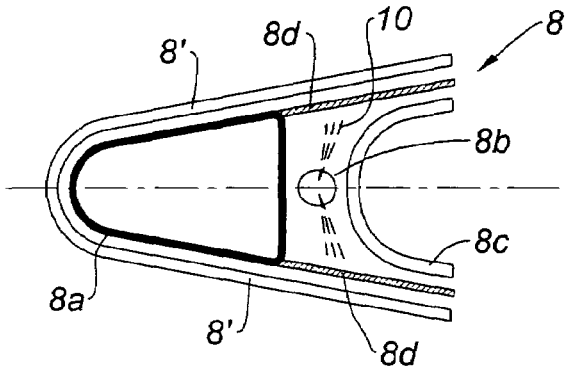
FIG. 6 represents a view in section of a second form of implementation of the flame holder arm of the turbojet of the invention.

With reference to FIG. 6, a plate 8*d* can be attached directly to the cooling jacket 8*a*. In this case, the arm 8 includes two protective plates 8*d*, extending more or less parallel to the two walls forming the branches of the U-section of the arm 8, these two plates 8*d* being fixed to the cooling jacket 8*a* of the arm 8, in its downstream portion. Attachment can be by any means of attachment. The plates 8*d* preferably extend up to the trailing edges of the arm 8, over all of its radial height. The plates 8*d* can either be attached to the cooling jacket 8*a* or fixed to the walls 8' of the arm 8, in the same way as before, for example. Operation of the arm 8 and protection of the walls 8' by the protective plates 8*d* are similar to those described previously. The advantage of this solution is the continuity between the protective plates 8*d* and the cooling jacket 8*a*, excluding all possible contact between the fuel and the walls 8' of the arm 8.

Figure 7:
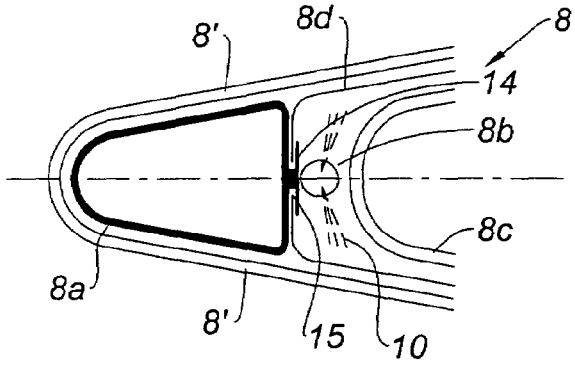
FIG. 7 represents a view in section of a third form of implementation of the flame holder arm of the turbojet of the invention.

With reference to FIG. 7, it is possible to provide a U-section plate 8*d*, that includes a radial recess 15 in the central part of the wall forming the base of its U-section, extending from a radial extremity of the plate 8*d* virtually up to its other radial extremity. The plate 8*d* is slid into a T-section part 14 attached to the cooling jacket 8*a* by the base of the T. This part 14 thus forms a slide for the protective plate 8*d*, at the level of its recess 15, which is slid onto it up to the point where its unrecessed radial extremity comes up against part 14. It can be locked to part 14. Thus, the protective plate 8*d* protects not only the walls 8' of the arm 8 by means of the walls forming the branches of its U-section, extending up to the trailing edge of the arm 8, but also the cooling jacket 8*a* by means of the wall forming the base of its U-section, completed by the wall of the slide 14 forming the bar of its T-section. The operation of the arm 8 and its protection by the protective plate 8*d* are otherwise quite comparable to what we have seen previously. The advantage of this method of implementation of the protective plate 8*d* is its ease of replacement, by a simple sideways movement in the slide 14. In addition, the plate 8*d* takes the form of a single part, to protect all of the walls 8' of the arm 8.

In order to increase its life expectancy, the protective plate 8*d*, in its downstream area close to the trailing edge of the arm 8, can be shaped otherwise than a simple plate, irrespective of its overall shape.

Figure 8:
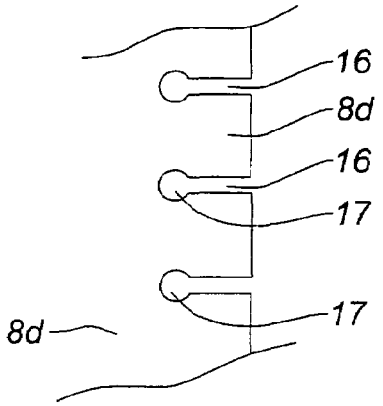
FIG. 8 represents a schematic outline view of a particular form of implementation of the protective plate of the flame holder arm of the turbojet of the invention and FIG. 9 represents a view in schematic section of another particular form of implementation of the protective plate of the flame holder arm of the turbojet of the invention.
Figure 9:
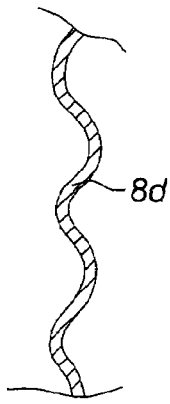

With reference to FIG. 8, the downstream end wall of the protective plate 8*d* can include slots 16, which are used to absorb the deformations to which the plate 8*d* is subjected. These slots 16 can be completed, where appropriate, by circular recesses 17 at their upstream ends, which then allows even greater deformations of the portions of plate 8*d* located between two slots 16.

According to another form of implementation, the walls of the plate 8*d* can present, in their downstream end portion, or even over all of their wall that is more or less parallel to a wall 8' of the arm 8, a section, seen in transverse section in relation to the general plane of the wall, of corrugated shape, which allows the deformations associated with the thermal gradients to be absorbed. In fact, this type of corrugation is generally the result of the deformations, and being able to do it in advance allows one to pre-stress the plate 8*d* to some degree.

The invention has been presented in relation to a fuel injection device in the primary gas flow which is a radial arm, but it goes without saying that the invention applies to all types of fuel injection device in the primary gas flow, and a ring in particular.

The invention claimed is:

1. A turbojet including an afterburner channel for heating of a gas stream, at least one injection device for injecting fuel into the gas stream, the injection device comprising:

an open chamber, with a U-shaped section, having at least one wall and within which extends a fuel injector that injects fuel in at least one direction, a cooling jacket in the open chamber, alongside the base of the U-shaped section, a protection device interposed between the fuel injector and the wall, in a fuel-injection direction so as to prevent a direct impact of the fuel from said fuel injector onto said wall, and a protective screen positioned downstream of said fuel injector and configured to protect the fuel injector tube from ignited fuel, wherein said protection device is located between said protective screen and said wall, and wherein said protection device and said protective screen are configured and positioned with respect to each other so as to define channels between said protection device and said protective screen for the fuel to be ejected through said channels and beyond said wall of the open chamber before being ignited.

2. A turbojet in accordance with claim 1, wherein the protection device includes at least one plate.

3. A turbojet in accordance with claim 1, wherein the injection device forms a radial arm.

4. A turbojet in accordance with claim 3, wherein the protection device extends over all of the radial height of the radial arm.

5. A turbojet in accordance with claim 1, wherein the fuel injector includes at least one tube, supplied with the fuel and including fuel-injection jets.

6. A turbojet in accordance with claim 1, wherein the fuel injector is placed between walls forming the branches of the U-shaped section.

7. A turbojet in accordance with claim 1, wherein said U-shaped section includes a first branch and a second branch, and said protection device includes a first plate substantially parallel to said first branch and a second plate substantially parallel to said second branch.

8. A turbojet in accordance with claim 7, wherein each plate is attached to a wall to which the plate is substantially parallel.

9. A turbojet in accordance with claim 7, wherein each plate is attached to the cooling jacket.

10. A turbojet in accordance with claim 2, wherein the plate includes a U-shaped section and a radial recess in a central part of the base of the U-shaped section of the plate, which is slid onto a part forming a slide, attached to the cooling jacket.

11. A turbojet in accordance with claim 2, wherein the plate includes slots.

12. A turbojet in accordance with claim 2, wherein the plate includes a portion of corrugated wall.

13. A turbojet in accordance with claim 1, wherein the injection device forms a ring.

14. A turbojet in accordance with claim 1, wherein said U-shaped section includes a first branch and a second branch, and said protection device includes a first plate and a second plate, wherein said first plate is between said fuel injector and said first branch so as to prevent direct impact of the fuel from said fuel injector onto said first branch, and wherein said second plate is between said fuel injector and said second branch so as to prevent direct impact of the fuel from said fuel injector onto said second branch.

15. A turbojet in accordance with claim 14, wherein said first plate is substantially parallel to said first branch, and said second plate is substantially parallel to said second branch.

16. A turbojet in accordance with claim 14, comprising a plurality of flame holder arms, each flame holder arm being configured as said injection device, wherein said flame holder arms are arranged around the circumference of said heating channel and extend radially inside said heating channel from a heating channel jacket.

17. A turbojet in accordance with claim 16, further comprising a plurality of fuel-injector arms, each fuel-injector arm having a fuel injector, wherein said fuel-injector arms are arranged around the circumference of said heating channel and extend radially inside said heating channel from said heating channel jacket, wherein said fuel-injector arms are positioned upstream relative to said flame holder arms.

18. A turbojet in accordance with claim 17, wherein said flame holder arms are angularly offset in relation to said fuel-injector arms so that, when viewed face on, each fuel injector arm is located between two adjacent flame holder arms and equidistant from each of said two adjacent flame holder arms.

19. A turbojet in accordance with claim 1, wherein the protective screen is U-shaped with arms substantially parallel to said protection device.

20. A turbojet in accordance with claim 1, wherein said protection device includes two distinct plates separated from each other, each plate being between said wall and said protective screen.

21. A turbojet in accordance with claim 1, wherein said protection device is mounted to said wall via a plurality of pins, and said protective screen is mounted to said protection device via said plurality of pins.

* * * * *